United States Patent [19]

Williamson

[11] Patent Number: 4,949,973

[45] Date of Patent: Aug. 21, 1990

[54] PRACTICE DEVICE FOR BALL HITTER OR KICKER

[76] Inventor: Bob C. Williamson, P.O. Box 24946, Lexington, Ky. 40524

[21] Appl. No.: 448,641

[22] Filed: Dec. 11, 1989

[51] Int. Cl.[5] ..... A63B 69/36; A63B 69/34; A63B 69/00

[52] U.S. Cl. ..... 273/185 D; 273/200 R; 273/197 A; 273/55 B; 273/DIG. 30; 273/58 C; 273/346

[58] Field of Search ..... 273/184 B, 184 R, 185 D, 273/185 C, 185 R, 200 R, 200 B, 197 A, 197 R, 55 B, 29 A, 26 E, DIG. 30, 58 C, 346

[56] References Cited

U.S. PATENT DOCUMENTS

| | | | |
|---|---|---|---|
| 2,656,720 | 10/1953 | Sonnett | 273/185 D |
| 3,087,726 | 4/1963 | Pogue | 273/55 B |
| 4,049,267 | 9/1977 | Forrest | 273/55 B |
| 4,191,372 | 3/1980 | Keller | 273/DIG. 30 |
| 4,261,564 | 4/1981 | Holahan | 273/55 B |

*Primary Examiner*—George J. Marlo
*Attorney, Agent, or Firm*—Cushman, Darby & Cushman

[57] ABSTRACT

A practice ball intended to be hit or kicked in an downfield direction is mounted onto a rod. An opposite end of the rod is journalled to a base by a swivel joint or ball joint which lies on a datum line which extends downfield in a datum horizontal direction. A succession of angles counterclockwise from and clockwise from the datum line are laid-out on the base, with reference to a vertical axis through the joint. A teeing-up pad is located upfield from the joint; it may, for instance, be provided by a rug of artifical turf provided at a first site on the base. A capture pad is located downfield from the joint, preferably with the datum line and succession of angles laid-out on it. A particular region of the ball and a corresponding particular region of the capture pad are covered with cooperable hook and fleece fasteners, e.g. Velcro fasteners, such that when the ball is hit or kicked, it rises over the joint on the rod, and lands and becomes captured on the capture pad in a way that permits the player, and others such as instructors or fellow players to determine the accuracy of directionality of the hit, kick, shot or the like in relation to a desired or pre-announced direction. In some instances, the practice ball in the teed-up position may be elevated on the rod rather than at rest on a teeing-up pad.

8 Claims, 4 Drawing Sheets

PRACTICE DEVICE FOR BALL HITTER OR KICKER

BACKGROUND OF THE INVENTION

There are several sports in which a ball is struck by a player using his or her hands or feet, with or without the aid of a tool such as a bat or club.

Most often, part of a player's skill is to hit or kick the ball not only at a desired moment, and with a desired forcefulness, but also in a desired direction (i.e., so as to have its trajectory as projected onto a horizontal surface, usually the ground plane, have a particular angle, about a vertical axis, relative to a datum direction along the horizontal surface).

It is not surprising, then, that players seek to develop their skills, including their skill of directionality of projection of a hit or struck ball.

Typical are the players who hit balls by the bucket at driving ranges and football players who spend hours practicing place kicking, punting, drop kicking and the like.

A well-recognized by-product of such practice is balls to be retrieved. The by-product does not present a problem when the player has a cooperative relationship with another person, such as in football practice, when a second payer, cooperating with the first, can be practicing catching and running. But there are times and instances in which ia cooperative relationship is not available, or is only available at an unacceptable cost, such as when a practicer of golf might not be able to afford to pay another person to retrieve the hit balls, or may not have a sufficiently large supply of balls to hit, necessitating frequent interruptions for ball retrieval.

One conventional solution to such problems is the provision of a net, often one with a target painted on it or otherwise provided in relation to it. The net is placed much closer to player than the ball would otherwise travel when hit or kicked. Accordingly, the time and effort needed for ball retrieval, and the stock of balls needed for carrying out a reasonably-paced practice session are all reduced.

The net-type target concept is a good one, but a player may have difficulty remembering, after the ball has struck the net and fallen to the ground just where the ball did hit.

The addition of mechanical or electronic sensors in connection with the net for giving the player a lasting indication of the trajectory of the ball, and particularly where it struck the target are elaborations which only increase the bulk and expense of an already generally large and expensive accessory to the practice session.

SUMMARY OF THE INVENTION

A practice ball intended to be hit or kicked in an downfield direction is mounted onto a rod. An opposite end of the rod is journalled to a base by a swivel joint or ball joint which lies on a datum line which extends downfield in a datum horizontal direction. A succession of angles counterclockwise from and clockwise from the datum line are laid-out on the base, with reference to a vertical axis through the joint. A teeing-up pad is located upfield from the joint; it may, for instance, be provided by a rug of artificial turf provided at a first site on the base. A capture pad is located downfield from the joint, preferably with the datum line and succession of angles laid-out on it. A particular region of the ball and a corresponding particular region of the capture pad are covered with cooperable hook and fleece fasteners, e.g. Velcro fasteners, such that when the ball is hit or kicked, it rises over the joint on the rod, and lands and becomes captured on the capture pad in a way that permits the player, and others such as instructors or fellow players to determine the accuracy of directionality of the hit, kick, shot or the like in relation to a desired or pre-announced direction. In some instances, the practice ball in the teed-up position may be elevated on the rod rather than at rest on a teeing-up pad.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
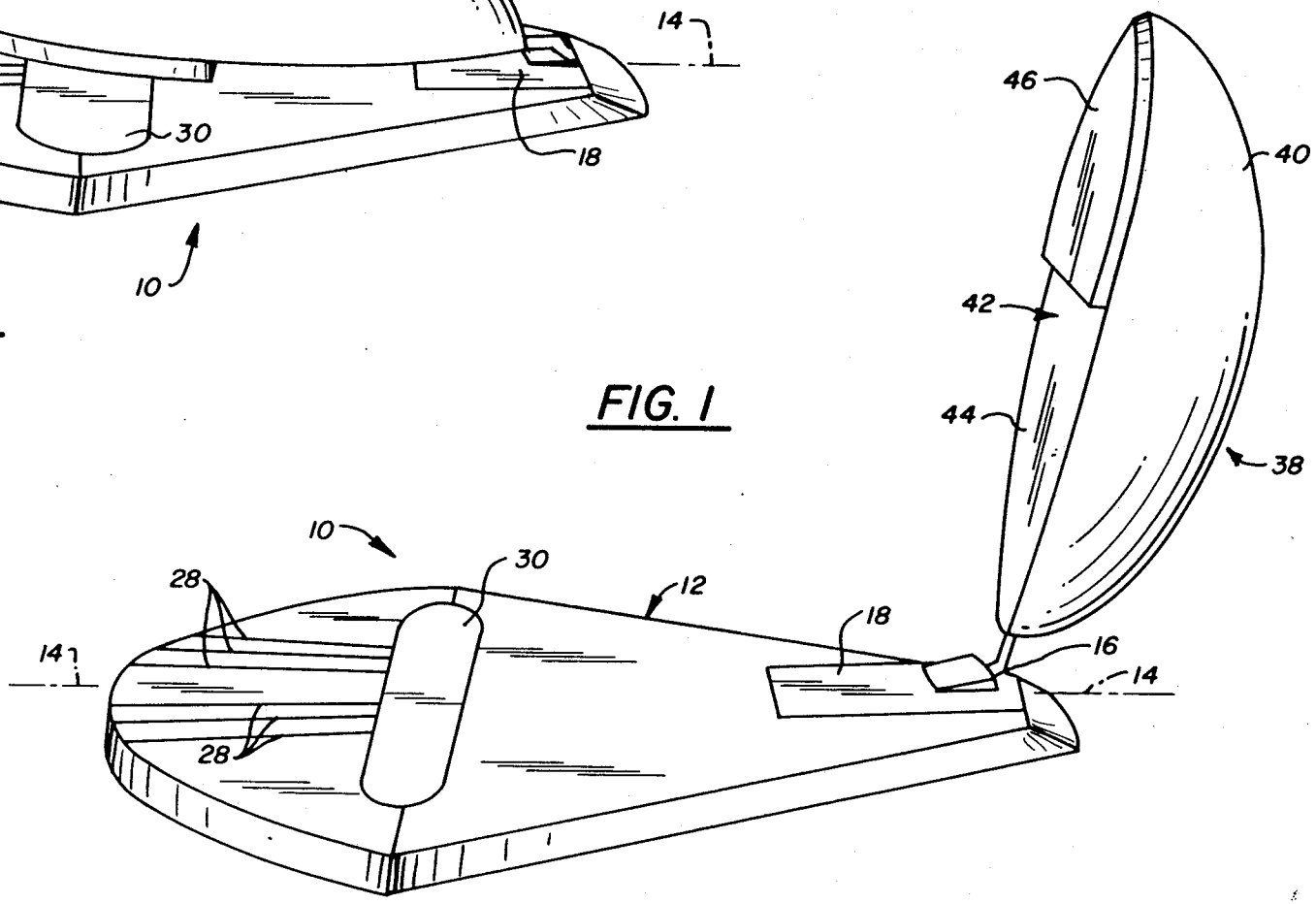
FIG. 1 is a perspective view of a football practice version of the device, teed-up, ready to be kicked.
Figure 3:
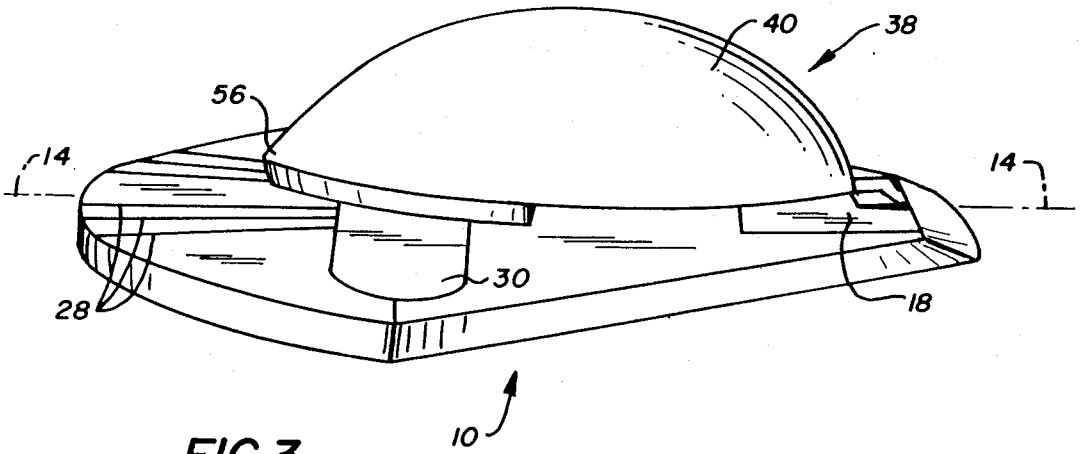
FIG. 3 is a similar perspective view of the device of FIG. 1, after the ball has been kicked.

A football practice version of the device is shown at 10 in FIGS. 1–7 (portions only being depicted in FIGS. 4–7).

The device 10 includes a base 12 e.g. made of a suitable plate of metal, wood, plastic material, a laminate or composite of the foregoing or the like.

On the base 12 at an intermediate location on its horizontal medial line 14 is mounted a swivel joint subassembly 16. The subassembly 16 includes a stationary plate 18 which is secured by means of bolts or other convenient fasteners, e.g., installed at 20, to the base 12. A rotary plate 22 is journalled on the stationary plate via ball bearings 24 and conventionally secured therewith so as to provide a rotary joint in which the rotary plate 22 is capable of free rotation about a substantially vertical axis 26 (which lies on the datum line 14).

Downfield from the axis 26, the base 12 has its upper surface visibly provided with an arrangement of rays 28 (which may, for instance, be painted stripes). These extend comparably at various gradations to the left and to the right of (i.e., clockwise from and counterclockwise from) an origin coincident with the axis 26.

Also on a portion of the downfield region of the upper surface of the base which can be characterized a capture pad, the device 10 is provided with one of the types of cooperable fasteners of a hook and fleece fastener set, e.g. a band of hooks 30.

The rotary plate 22 is shown having two diametrically spaced, upwardly-projecting flanges 32 which have a set of sockets or openings 34 provided therein, which are aligned with one another on a horizontal axis 36 which preferably intersects the vertical axis 26.

The practice football 38 is shown having resemblance in size, appearance and consistency in the upfield half (on a longitudinal cutting plane) of a conventional football. It may consist of half the usual covering 40 of a footfall, stuffed with the same type of stuffing (not shown) used for stuffing medicine balls, secured by suitable fastening means such as sewing and/or adhesive, to a stiff, football oblong profile-shaped back plate 42, e.g. made of wood, metal, plastic material, a laminate or composite of the foregoing, or the like.

The outer face 44 of the plate 42 is provided with a patch or band of the other of the types of cooperable fasteners of a hook and fleece fastener set, e.g. a patch of fleece 46.

A rod 48 is fixedly mounted to the back plate 42 so as to extend along the medial line of the back plate 42 past one tip of the back plate 42. A typical length of extension is about one to about ten inches.

The rod 48 at the end of its extending portion 50 is fixedly mounted to a cross-rod 51 at a medial point, so as to form a T-shaped rod subassembly 52.

The practice football 38 is mounted to the swivel joint on the base by installing the outer ends 54 of the cross-rod 51 in the respective sockets or openings 34, which thereby provide bearing means journalling the T-shaped rod subassembly 52 on the base for rotation about the horizontal axis 36.

In use, the football is erected on the base as though it were teed-up and ready to be kicked, the rod being generally upright and the swivel joint being rotated to a desired position (usually one in which the rod 48 lies in a vertical plane which contains the datum line 14).

The practicing player (not shown) approaches the practice ball from upfield and kicks it towards downfield. Instead of travelling very far, the practice ball arches over and impacts the capture pad, the hook and fleece fasteners engaging to maintain the location of the practice ball at its point of impact. As the ball was kicked, not only was angular movement possible about the horizontal axis 36 to lay the practice ball down on the capture pad, but angular movement was possible around the vertical axis. The amount of the latter which will take place in any instance will depend on how squarely or directionally the ball was kicked relative to the datum line, so that the angular relationship of the rod 48 (or the top 56 of the ball relative to the progressively radiating angle lines 28 from the datum line 14 will provide information useful to the kicker and others as to the direction the ball would have gone had it been a free ball rather than a tethered one.

Figure 8:
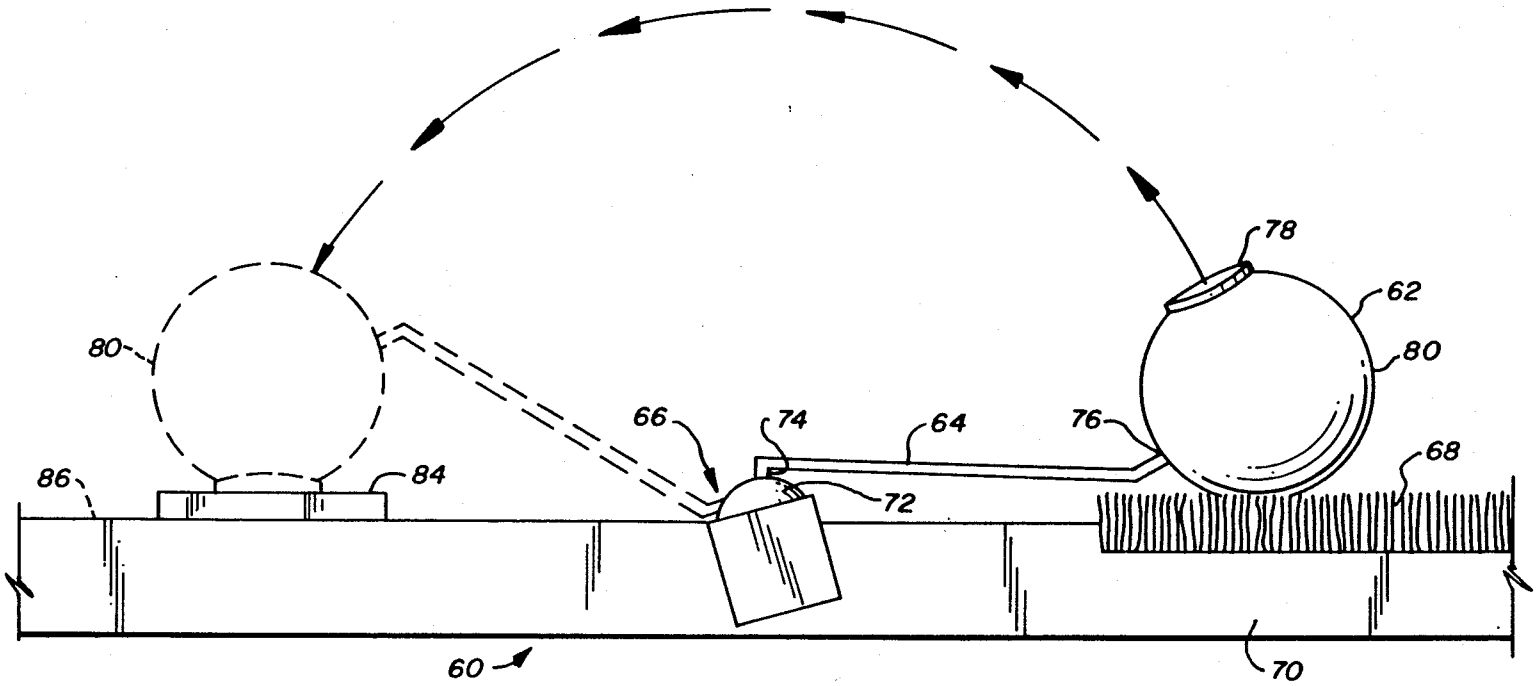
FIG. 8 is a fragmentary and somewhat schematic side elevational view of a golf practice version of the device, with the practice ball shown teed-up in full lines, and at rest on the capture pad in dashed lines.

A golf practice version of the device is shown at 60 in FIG. 8.

The device 60 is substantially similar to the device 10 as described above, except as noted below:

The ball 62 simulates a golf ball.

The rod 64 emerges out of the ball 62 from a fixed mounting internally of the ball by any convenient means.

The cross-rod and two axis swivel joint of the first embodiment are replaced by an upwardly-presented universal (e.g., ball and socket) joint 66.

The initial position of the ball is one an artificial turf pad 68 located on the base 70 upstream of the joint 66 (and usually, although not necessarily on the medial line defined as in relation to FIGS. 1–7).

The rod 64, which preferably is a stiff element, e.g. made of steel (as in FIGS. 1–7), preferably has the shape shown in FIG. 8, e.g. an extremely attenuated S-shape so as to curve down into the joint ball 72 at 74, and up into the lower front of the practice golf ball 62 at 76.

Neither the location of the rod at 76, nor the location of the Velcro patch at 78 interferes with hitting of the ball at 80, e.g. in a typical way using a conventional golf club and a conventional stance and swing.

In plan view, the base 70 is typically fan-shaped, e.g. about twenty-two inches from tee pad to Velcro capture pad 84 and about thirty-three inches across at its widest. Accordingly, the rod 64 is typically about eight to twelve inches in length between the socket ball and the simulated golf ball.

The upper surface of the base is provided with a ray pattern (not shown) but indicated at 86, substantially like the one described above in relation to FIGS. 1–7, so that deviation of the ball from the datum line or a desired or announced vector can easily be assessed by the player and others after the ball has been hit.

For convenience, the term "struck" may sometimes be used herein as a generic synonym for both "hit" and "kicked".

It should now be apparent that the practice device for ball hitter or kicker as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A practice device for a ball hitting or kicking player, comprising:

a base which extends horizontally and is adapted to be supported on a ground plane, said base having a medial line which extends upfield and downfield in relation to a desired direction;

means providing an upwardly-presented rotary joint on said base on a vertical axis disposed at an intermediate location along said medial line;

a rod mounted to said rotary joint by one end of said rod, said rotary joint providing for rotation of said rod about said vertical axis and also about a horizontal axis generally intersecting said vertical axis;

a practice ball means mounted to said rod distally of said one end thereof, whereby a portion of said rod extends between said practice ball means and said rotary joint;

a pattern of corresponding rays marked on said base downfield of said vertical axis to the left and to the right of said medial line and having an origin at said vertical axis;

a transversally extensive band of one member of a set of hook and fleece fasteners secured on said base downfield of said vertical axis, and a patch of an opposite member of said set of hook and fleece fasteners secured on said practice ball means, at a site selected such that if said practice ball means is teed-up and struck towards downfield, said practice ball means will strike the base in a manner which causes the hook and fleece fasteners to engage, capturing the practice ball means at an impact site which may be spatially assessed in relation to said medial line by observing its location with assistance from said pattern of rays.

2. The practice device of claim 1, wherein:

said practice ball means simulates a football.

3. The practice device of claim 2, wherein:

said practice ball means includes a replica of an upfield longitudinal half of a football backed by a plate secured to said rod, said opposite member of said set of hook and fleece fasteners being provided on said plate.

4. The practice device of claim 3, wherein:

said rotary joint includes a first rotary joint means comprising a stationary plate having a rotary plate journalled thereon for rotation abut said vertical axis, and said rod is secured to a cross-rod to provide a T-shaped member; said cross-rod being journalled on said rotary plate for rotation about said horizontal axis.

5. The practice device of claim 1, wherein:

said practice ball means simulates a golf ball.

6. The practice device of claim 5, wherein:

said rotary joint is a ball and socket joint.

7. The practice device of claim 6, wherein:

said rod is of attenuated S-shape so that when said practice ball means is teed-up upfield of said ball and socket joint, said rod projects down into a ball of said ball and socket joint at one end, and up into said practice ball means at an opposite end.

8. The practice device of claim 7, further including:

a pad of artificial turf on said base upfield of said ball and socket joint and on which said practice ball means rests when teed-up.

* * * * *

UNITED STATES PATENT AND TRADEMARK OFFICE

CERTIFICATE OF CORRECTION

PATENT NO. : 4,849,973

DATED : JULY 18, 1989

INVENTOR(S) : KATSUHISA KUBOTA

It is certified that error appears in the above-identified patent and that said Letters Patent is hereby corrected as shown below:

Col. 2, line 22, "block" should be --waveform--; and "of" should be --for--.

Col. 3, line 21, after "circuit" insert --formed--;
line 22, delete "formed".

Figure 4:
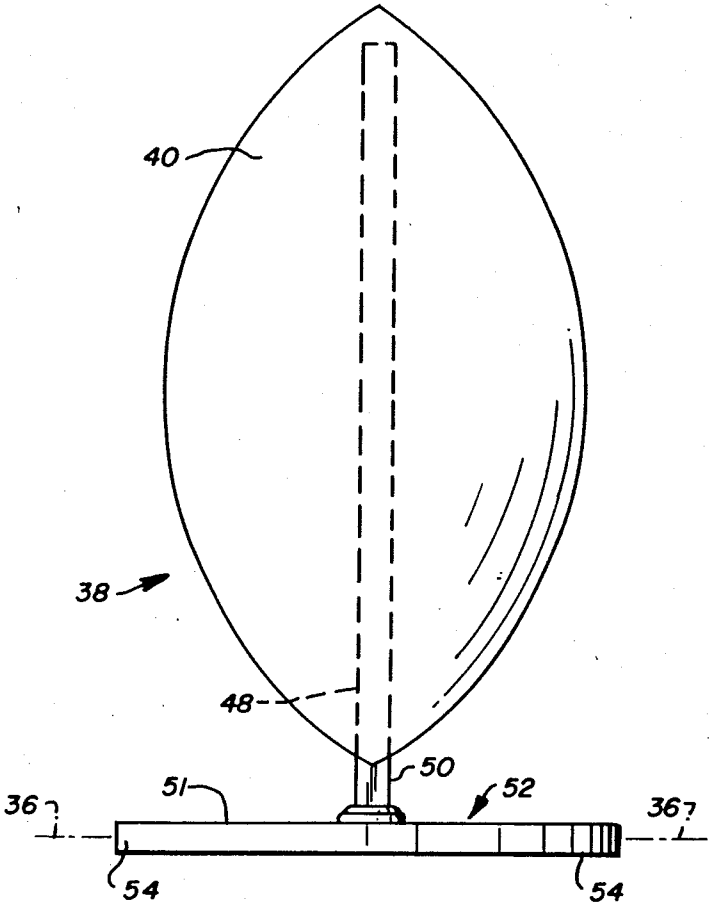
FIG. 4 is a rear elevation view of the ball-rod subassembly.
Figure 2:
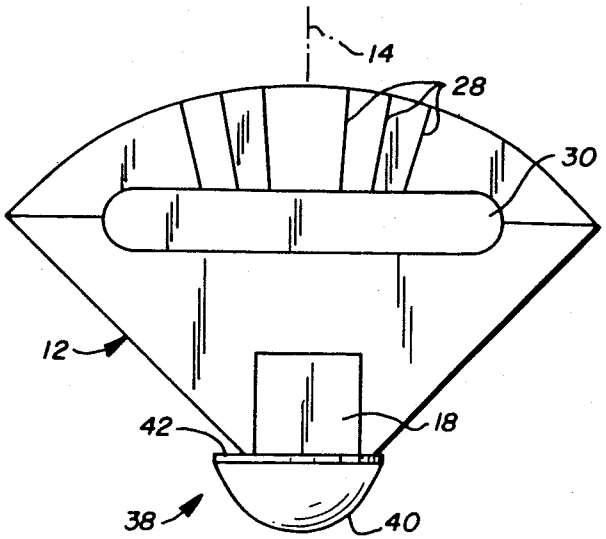
FIG. 2 is a top plan view thereof.
Figure 5:
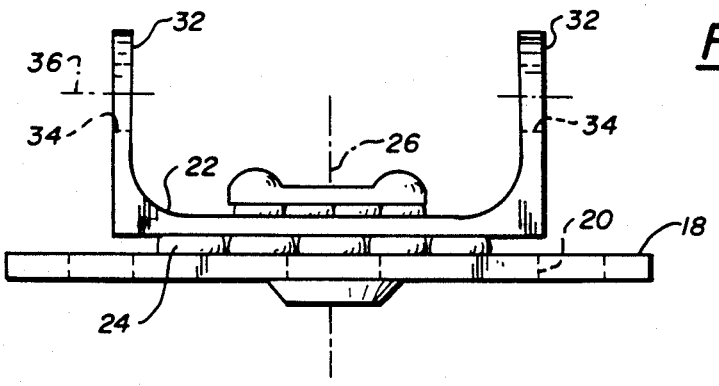
FIGS. 5–7 are front, right end and top plan views of the swivel joint subassembly.
Figure 6:
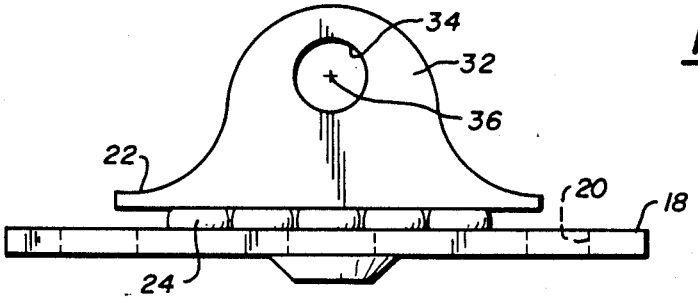
Figure 7:
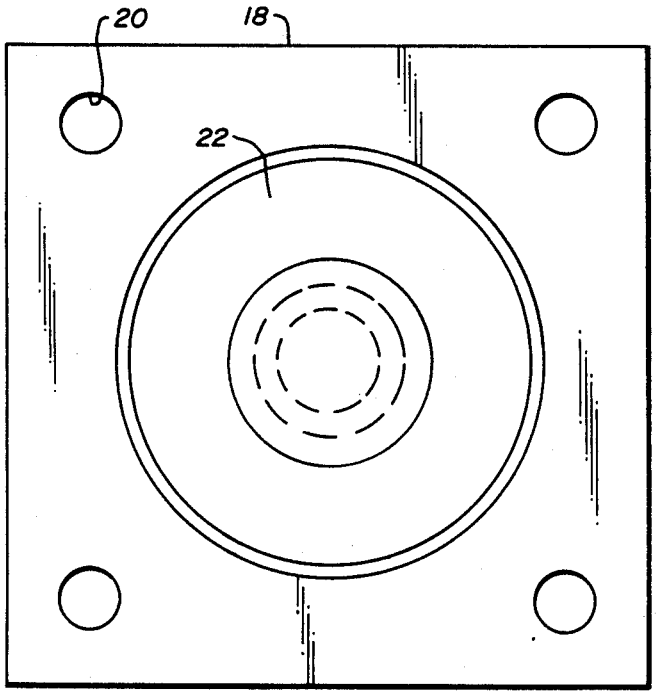

Col. 4, line 8, "FIG. 5," should be --FIG. 4,--;
line 58, "response" should be --responsive--.

Col. 5, line 23, "(- --$_3$))," should be --(-$Q_3$)),--;
line 48, "wires" should be --wired--.

Col. 7, line 5, "sigal" should be --signal--.

Signed and Sealed this

Twelfth Day of June, 1990

*Attest:*

HARRY F. MANBECK, JR.

*Attesting Officer*

*Commissioner of Patents and Trademarks*